US007337492B2

(12) United States Patent
Matsuno et al.

(10) Patent No.: US 7,337,492 B2
(45) Date of Patent: Mar. 4, 2008

(54) VACUUM CLEANER HAVING A NOISE BLOCKING MEMBER FACING AN INTAKE VENT OF A MOTOR FAN

(75) Inventors: Mai Matsuno, Hadano (JP); Kiyoshi Ebe, Hiratsuka (JP); Masatoshi Tanaka, Ebina (JP); Kenji Harada, Hadano (JP); Ritsuo Takemoto, Hadano (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 577 days.

(21) Appl. No.: 10/503,450

(22) PCT Filed: Jul. 24, 2003

(86) PCT No.: PCT/JP03/09391

§ 371 (c)(1),
(2), (4) Date: Aug. 3, 2004

(87) PCT Pub. No.: WO2004/010839

PCT Pub. Date: Feb. 5, 2004

(65) Prior Publication Data

US 2005/0102790 A1 May 19, 2005

(30) Foreign Application Priority Data

Jul. 25, 2002 (JP) ..... 2002-216695
Jul. 25, 2002 (JP) ..... 2002-217130

(51) Int. Cl.
*A47L 9/22* (2006.01)

(52) U.S. Cl. ..... 15/326; 15/327.2; 15/327.7; 15/412

(58) Field of Classification Search ..... 15/327.2, 15/327.7, 412, 326, DIG. 1
See application file for complete search history.

(56) References Cited

U.S. PATENT DOCUMENTS

| | | | | |
|---|---|---|---|---|
| 1,209,720 | A * | 12/1916 | Kirby | 15/412 |
| 2,281,858 | A * | 5/1942 | Pierce | 15/326 |
| 4,972,541 | A | 11/1990 | Smith, Jr. | |
| 6,108,864 | A | 8/2000 | Thomas et al. | |
| 6,311,366 | B1 * | 11/2001 | Sepke et al. | 15/412 |
| 6,345,411 | B1 * | 2/2002 | Kato et al. | 15/412 |

FOREIGN PATENT DOCUMENTS

| | | |
|---|---|---|
| JP | 51-10861 | 1/1976 |
| JP | 05-199954 A | 8/1993 |
| JP | 7-250788 A | 10/1995 |
| JP | 2002-017635 A | 1/2002 |
| JP | 2002-034864 A | 2/2002 |

* cited by examiner

*Primary Examiner*—Theresa T. Snider
(74) *Attorney, Agent, or Firm*—Frishauf, Holtz, Goodman & Chick, P.C.

(57) ABSTRACT

In an electric vacuum cleaner having an intake air opening 18 disposed in a front portion of a main body case 17, a dust collection case 19 which communicates with the intake air opening 18, and a motor fan 20 provided in a back portion of the main body case, and an intake air passage 23, 24, 25 from the dust collection case 19 to the motor fan 20 being formed, a noise blocking member 14*d* having a specific gravity larger than a material composing the main body case 17 and an area wider than a project area of an intake vent 20*a* is disposed in the intake air passage 25 facing to the intake vent 20*a* of the motor fan 20.

8 Claims, 6 Drawing Sheets

VACUUM CLEANER HAVING A NOISE BLOCKING MEMBER FACING AN INTAKE VENT OF A MOTOR FAN

This application is a U.S. National Phase Application under 35 USC 371 of International Application PCT/JP03/09391 filed Jul. 24, 2003.

TECHNICAL FIELD

The present invention relates to an electric vacuum cleaner including a dust separation section, a motor fan, and an intake air passage which is provided from the dust separation section to the motor fan.

BACKGROUND ART

There has been known a conventional electric vacuum cleaner which generates negative pressure by driving a motor fan and sucks dust and the like to be collected by the negative pressure.

A motor fan is generally disposed in a back part of a main body case which constitutes an outer wall of a cleaner main body, and an intake vent of its motor fan is directed forward. Collection members such as a dust collection filter and a dust collection case are disposed ahead of the motor fan, and the electric vacuum cleaner is constructed in order for the dust to be collected in the dust collection case while introducing the negative pressure into the dust collection case by the motor fan.

However, for the above electric vacuum cleaner, there has been a problem that the undesired sound generated by the rotation of the motor fan is very noisy.

It is, therefore, an object of the present invention to provide an electric vacuum cleaner capable of reducing the noise generated by rotation of a fan.

DISCLOSURE OF INVENTION

According to one aspect of the invention, an electric vacuum cleaner includes an intake air opening disposed in a front portion of main body case, a dust separation section which communicates with the intake air opening, and a motor fan provided in a back portion of the main body case. In addition, an intake air passage is provided from the dust separation section to the motor fan. Moreover, according to this aspect of the invention, a noise blocking member faces an intake vent of the motor fan with the intake air passage provided between the noise blocking member and the intake vent. The noise blocking member has a specific gravity that is larger than a specific gravity of a material composing the main body case. And a surface of the noise blocking member that faces the intake vent has an area that is larger than a project area of the intake vent, which is an area of the intake vent projected along a central axis of the intake vent on the surface of the noise blocking member.

According to another aspect of the invention, an electric vacuum cleaner includes an intake air opening disposed in a front portion of a main body case, a dust separation portion which communicates with the intake air opening, and a motor fan provided in a back portion of the main body case. In addition, intake air passage is provided from the dust separation section to the motor fan. Moreover, according to this aspect of the invention, a battery faces an intake vent of the motor fan via a wall of the intake air passage such that the intake air passage is provided between the noise blocking member and the intake vent. The battery has a specific gravity that is larger than a specific gravity of a material composing the main body case. And a surface of the battery that faces the intake vent has an area that is larger than a project area of the intake vent, which is an area of the intake vent projected along a central axis of the intake vent on the surface of the battery.

According to a further aspect of the invention, an electric vacuum cleaner includes an intake air opening disposed in a front portion of a main body case, a dust separation section which communicates with the intake air opening, and a motor fan provided in a back portion of the main body case. In addition, an intake air passage is provided from the dust separation section to the motor fan. Moreover, according to this aspect of the invention, the motor fan is tilted downwardly so that an intake vent of the motor fan is directed obliquely forward toward the front portion of the main body case and obliquely downward. And a battery, for driving the motor fan, is positioned under a bottom wall of a bottom portion of the intake air passage, wherein the bottom wall faces the intake vent.

BEST MODE FOR CARRYING OUT THE INVENTION

Hereinafter, embodiments of an electric vacuum cleaner according to the present invention will be described according to the drawings.

Figure 2:
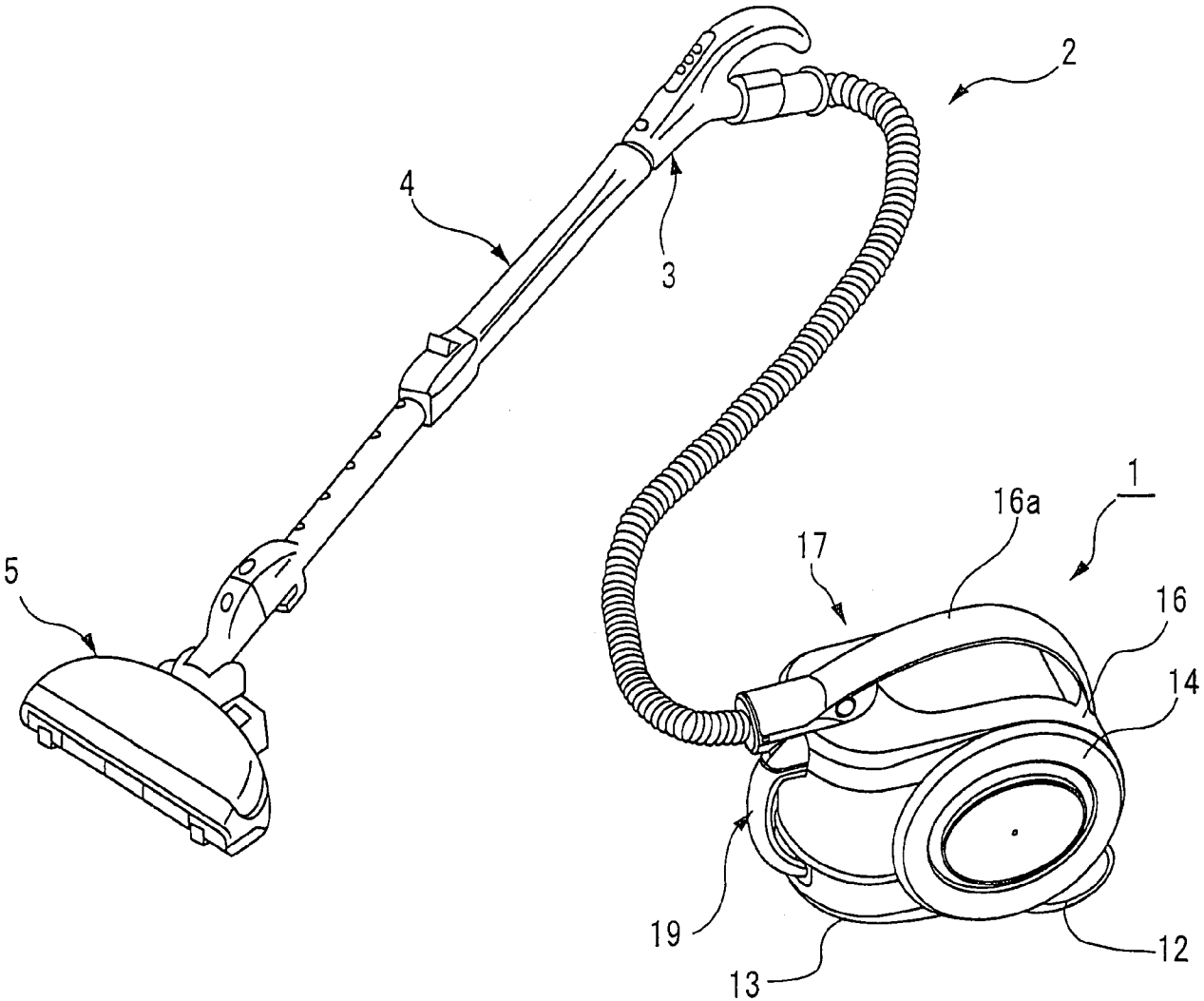
FIG. 2 is a perspective view illustrating an electric vacuum cleaner according to the present invention.

In FIG. 2, reference character 1 denotes an electric vacuum cleaner main body (electric vacuum cleaner), reference character 2 a bellows-typed hose attachably and detachably connected ahead of the electric vacuum cleaner main body 1, reference character 3 a hand operating pipe provided with the leading end of the hose 2, reference character 4 a retractable extension pipe attachably and detachably connected to the hand operating pipe, and reference character 5 is a suction opening body attachably and detachably connected to the leading end of the extension pipe 4.

The electric vacuum cleaner 1 is provided with a main body case 17 which is made of a resin lower case 13 having a turning wheel 11 as a front wheel and a rear wheel 12, a resin upper case 14 disposed on the lower case 13, and a resin upper cover 16 having a carrying handle 16*a* openably and closeably attached to the upper case 14 through a hinge 15. An intake air opening 18 is formed in the front potion of the electric vacuum cleaner main body 1 by a part of the upper cover 16; the hose 2 is attachably and detachably connected to the intake air opening 18.

Further, in the front portion of the electric vacuum cleaner main body 1, a flat mounting portion 14*a* is formed below the intake air opening 18 by a part of the upper case 14, and a cup like dust collection case 19 is attachably and detachably mounted on the mounting portion 14*a*. A motor fan 20 is disposed in the back portion of the electric vacuum cleaner main body 1. The motor fan 20 is diagonally disposed in order for an intake vent 20*a* to be faced downward and frontward. A battery (noise blocking member: battery unit) 21 for driving the motor fan 20 is disposed below the motor fan 20.

The battery 21 consists of a storage battery, but it may be a battery unit which is made of a plurality of secondary cells and a cover bundling the plurality of secondary cells. The battery 21 is placed facing to the intake vent 20*a* of the electric fan 20 through an after-mentioned lateral wall (bottom wall portion) 14*d*. Namely, the battery 21 is disposed facing to the intake vent 20*a* of the motor fan 20.

Figure 6:
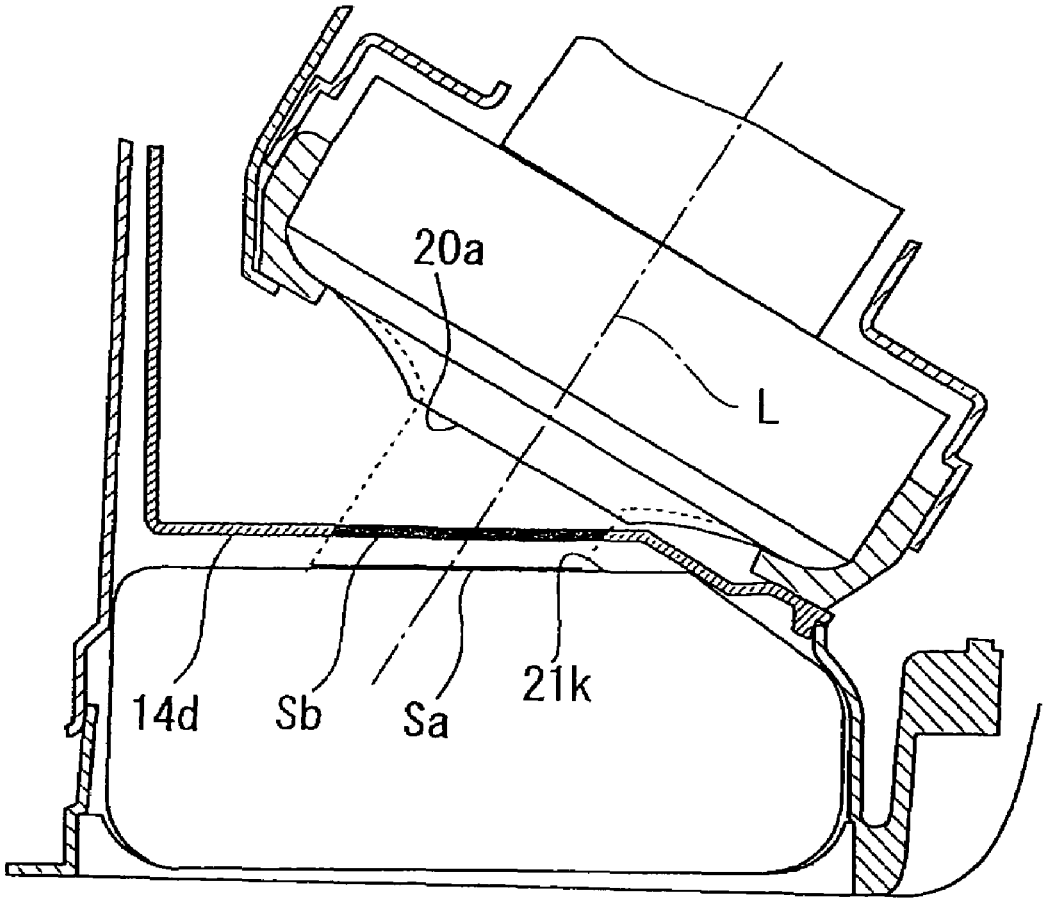
FIG. 6 is an explanatory view illustrating a projection plane of an intake vent of a motor fan.

Further, as shown in FIG. 6, an upper surface 21*k* of the battery 21 and the lateral wall 14*d* have areas larger than project areas Sa, Sb when the intake vent 20*a* of the motor fan 20 is projected on the upper surface 21*k* along the direction of the central axis line L of the intake vent 20*a*. The specific gravity of the battery (battery main body) 21 is larger than the specific gravity of resin composing the main body case 17.

Figure 5:
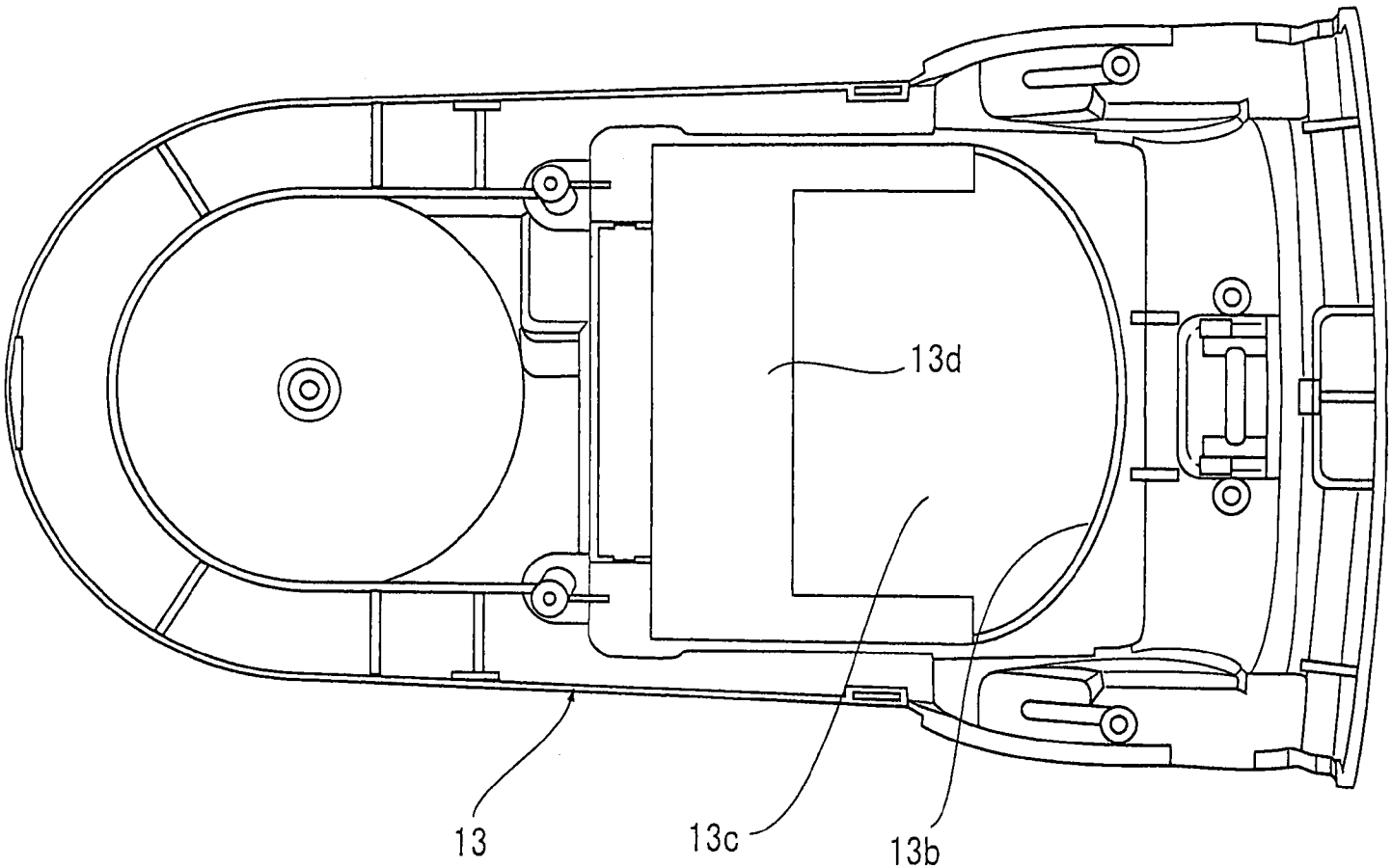
FIG. 5 is an explanatory view illustrating a lower case.

The lower case 13 is provided with a storage space 13*b*. A storage opening 13*a* for conducing the exchange of the battery 21, and the like is formed in the bottom surface of the storage space 13*b*. The storage opening 13*a* can open and close by the battery cover 22. As shown in FIG. 5, the upper surface of the lower case 13 is provided with an opening 13*c*, and a storage wall 13*d* of an upper wall is integrally formed thereto. The corner between the back surface and the bottom surface of the lower case 13 is formed with a concave portion 13*e* for charging in which a contact point (not shown) of a battery charge (not shown) capable of charging with storing the battery 21 is placed.

A first intake air passage 23 for communicating with an upper part opening 19*a* of the dust collection case 19 is formed on the upper cover 16.

The main body case 17 having an opening 24*a* on the upper surface is provided with a second intake air passage 24 extending up and down and a third intake air passage 25 for communicating with the second intake air passage 24 and also the intake vent 20*a* of the motor fan 20. The first intake air passage 23 of the upper cover 16 is communicated with the opening 24*a* of the second intake air passage 24, and a filter 26 is disposed thereto. The second intake air passage 24 is zoned by longitudinal walls 14*b*, 14*c*, and the like integrally formed to the upper case 14. The third intake air passage 25 is zoned by a lateral wall 14*d*, and the like integrally formed to the upper case 14. The bottom portion of the third intake air passage 25 is zoned by the lateral wall 14*d*. A part of the lateral wall 14*d* closes the opening 13*c* of the lower case as shown in FIG. 5, and comes into contact with the outer surface (upper surface) 21*k* of the battery 21.

The motor fan 20 is covered with a motor fan cover 27 having an opening 27*a*, and its vibration is absorbed by a rubber vibration isolation 28.

Next, an operation of the electric vacuum cleaner according to the above embodiment will be described. When the motor fan 20 is driven, the second and the first intake air passages 25, 24 become negative pressure states, and then the dust collection case 19 becomes under negative pressure through the first intake air passage 23 of the upper cover 16 and the upper side opening 19*a* of the dust collection case 19. With this negative pressure, dust is sucked from the suction opening body 5 together with air, and the sucked dust and air are sucked into the connection opening 18 of the upper cover 16 through the extension pipe 4 and the hose 2. The dust and air sucked into the connection opening 18 are introduced into the dust collection case 19.

The air and the dust introduced into the dust collection case 19 flows along the peripheral wall of the dust collection case 19 as spiral flow, and the dust and the air are separated while flowing as the eddy currents, and then the dust are accumulated on the bottom portion of the dust collection case 19. More specifically, the dust collection case 19 comprises the function as the dust collection section for separating dust from air and the function as a dust collection section for accumulating the separated dust.

The separated air is sucked into the second and the third intake air passages 24, 25 of the main body case 17 through the first intake air passage 23 of the upper cover 16 from the upper side opening 19*a* of the dust collection case 19; further the separated air is sucked into the intake vent 20*a* of the motor fan 20.

The air sucked into the intake vent 20*a* of the motor fan 20 is exhausted from the opening 27*a* of the motor fan cover 27, and is exhausted to the outside from an exhaust vent (not shown) disposed in the lateral of the rear wheel 12.

The outer wall of the battery 21 is covered by a cover (noise blocking member) made of a material (for example, iron, aluminum, coal tar, rubber, and the like) which has a specific gravity larger than a resin composing the main body case 17, so that the noise generated by the rotation of fan effused from the intake vent 20*a* of the motor fan 20 can be effectively insulated and reduced.

Figure 1:
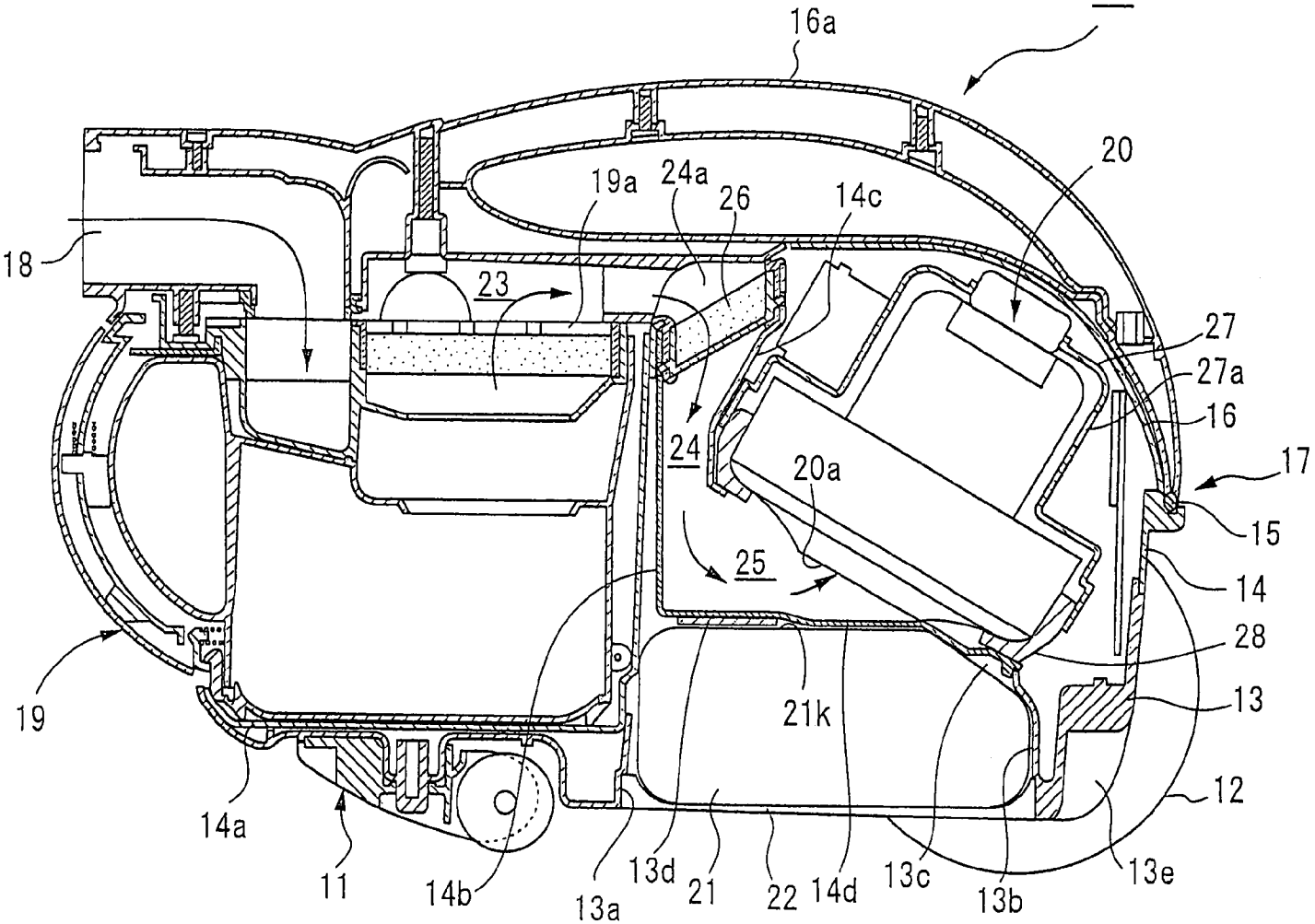
FIG. 1 is a longitudinal section view illustrating an electric vacuum cleaner main body according to an embodiment of the present invention.

Furthermore, although the battery cover 21 is covered by a cover having a light specific gravity, the battery main body has a large specific gravity, and also has a sufficient thickness (a height in the up and down direction in FIG. 1), such that the noise effused from the intake vent 20*a* of the motor fan 20 is effectively blocked and reduced by the battery 21. Accordingly, the noise leaked from the bottom of the vacuum cleaner main body 1 becomes small, and a silent electric vacuum cleaner can be obtained.

The air sucked into the first intake air passage 23 flows into the intake vent 20*a* of the motor fan 20 along the lateral wall 14*d*, so that the battery 21 is cooled down through the lateral wall 14*d*. The temperature of the air is low because of not cooling the motor fan 20, so that the battery 21 can be sufficiently cooled down. Further, the cooling efficiency can be improved by the contact between a part of the lateral wall 14*d* and the outer surface 21*k* of the battery 21.

The capacity flowing into the third intake air passage 25 is the same capacity which sucks dust; accordingly, the lateral wall 14*d* is cooled down by a large capacity. Consequently, the battery 21 can be sufficiently cooled down.

Further, the motor fan 20 is disposed with the state that one side of the motor fan is tilted to contact to the battery 21, enabling the height of the vacuum cleaner main body 1 to be lowered, and the air passage resistance to be small because the flowing direction of the air sucking from the third intake air passage 25 into the intake vent 20*a* of the motor fan 20 does not change on a large scale.

The lateral wall 14*d* may be separated from the upper case 14 composing a part of the main body case 17, and may be made of a material or materials (for example, duralumin, aluminum, iron, plumbum, and the like having larger thermal conductivity than a resin of the main body case 17) having a specific gravity larger than a resin (for example ABS, PP, and the like) composing the main body case 17. The member (noise blocking member) having a specific gravity larger than a resin composing the main body case 17 is accordingly used, the site facing to the intake vent 20*a* can effectively block (reduce) the noise generated by the rotation of the fan driven by the motor fan 20. In this case, a thin sheet having a substantially 3 mm thickness is used for the material, so that the thin sheet does not become a heavy material which has a negative influence on the total weight of the electric vacuum cleaner main body 1, enabling the noise to be insulated.

The cooling effect of the battery 21 can be further increased by having a good thermal conductivity of the heavy member.

In the above embodiment, the motor fan 20 is tilted to be disposed; even though the intake vent 20*a* is disposed downwardly without titling the motor fan 20, the noise of the fan can be certainly blocked and reduced because of placing the battery 21 in the position facing to the intake vent 20*a*. Accordingly, the noise can not spread from the bottom surface of the vacuum cleaner main body 1 with a flooring material, and the like, and a silent electric vacuum cleaner can be accomplished.

Figure 3:
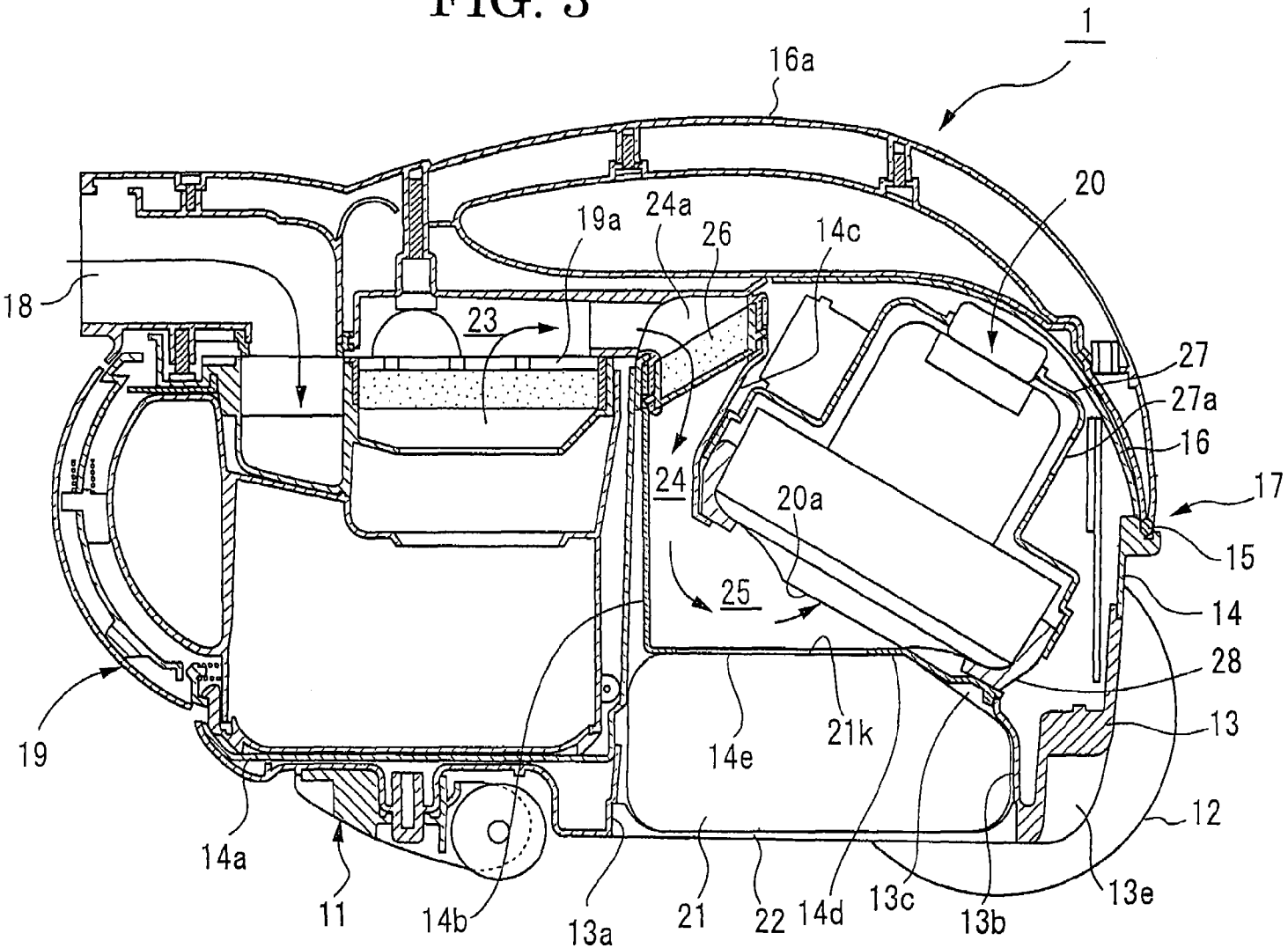
FIG. 3 is an explanatory view illustrating the electric vacuum cleaner according to the second embodiment.

FIG. 3 illustrates the electric vacuum cleaner main body 1 of the second embodiment. In the electric vacuum cleaner main body 1, an opening 14*e* is formed on a lateral wall 14*d*, an outer surface 21*k* of a battery 21 closes the opening 14*e* and zones a third intake air passage 25, the outer surface 21*k* of the battery 21 is cooled down by directly hitting the air flowing into the third intake air passage 25 against the third intake air passage 25. More specifically, a part of the third intake air passage 25 is configured by the battery 21, and the battery 21 is directly faced to an intake vent 20*a* of a motor fan 20. By this way, the cooling efficiency of the battery 21 is further improved.

In this case, the opening 14*e* of the lateral wall 14*d* is also closed by the outer surface 21*k* of the battery 21, and the noise of the fan of the motor fan 20 is blocked and reduced by the battery 21, so that the noise leaked from the bottom of the vacuum cleaner main body 1 becomes small as well as the first embodiment.

Figure 4:
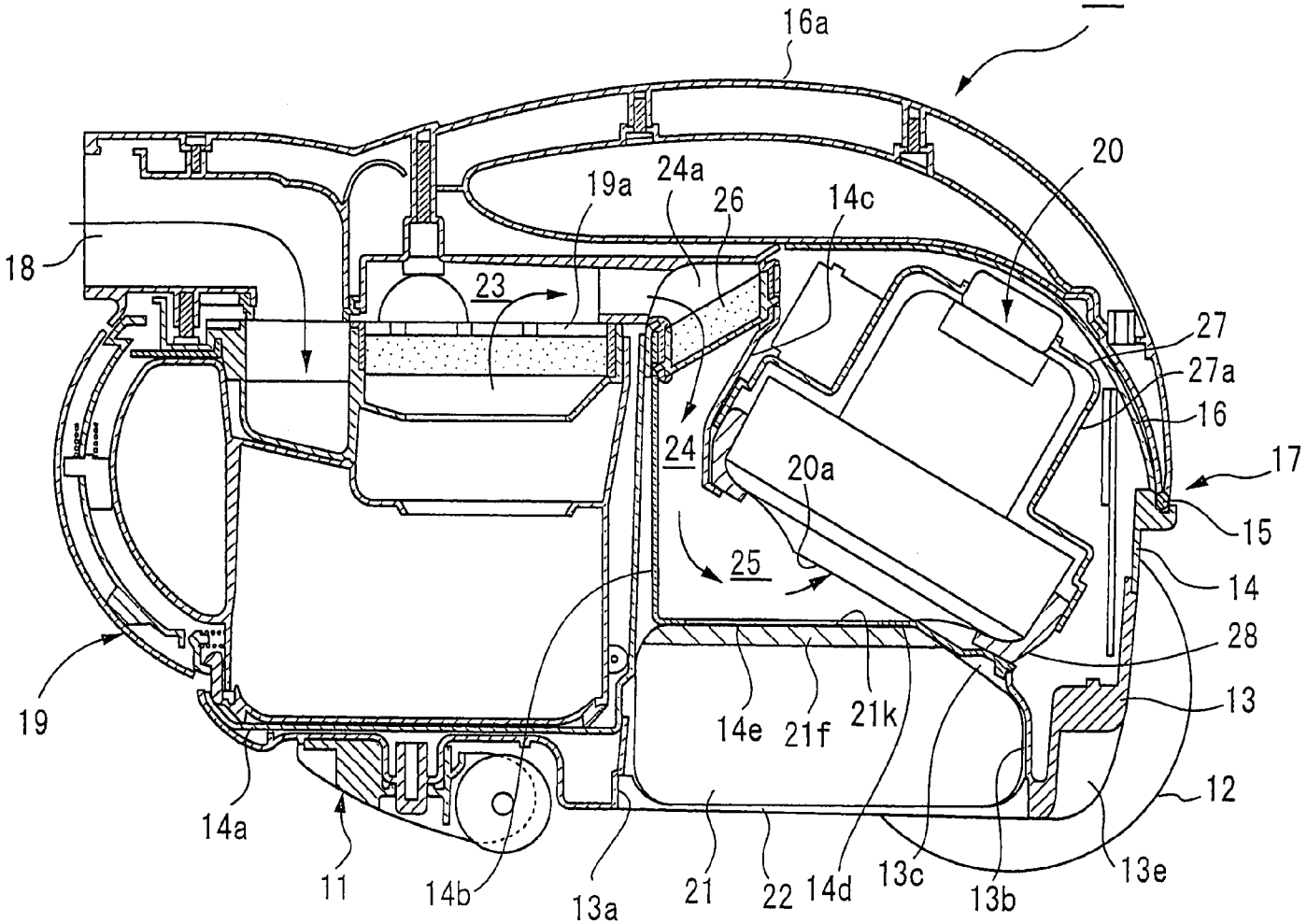
FIG. 4 is an explanatory view illustrating the electric vacuum cleaner according to the third embodiment.

FIG. 4 illustrates the electronic vacuum cleaner of the third embodiment. In this third embodiment, one side surface 21*f* of an outer surface 21*k* of a battery unit 21 facing to an opening 14*e* of a lateral wall 14*d* is made of a metal (member having higher thermal conductivity than resin of a main body case 17). The cooling efficiency of the battery 21 is accordingly further improved. Furthermore, since noise is blocked and reduced by the metal (noise blocking member) of one side surface 21*f*, the noise leaked from the bottom surface of the vacuum cleaner main body 1 can be further reduced. The metal may be applied to a part of the outer surface 21*k* of the battery 21 facing to the opening 14*e* of the lateral wall 14*d*.

EFFECT OF THE INVENTION

According to the present invention, the generation of noise of a motor fan can be reduced.

The invention claimed is:

1. An electronic vacuum cleaner comprising:

a main body case;

an intake air opening disposed in a front portion of the main body case;

a dust separation section which communicates with the intake air opening;

a motor fan provided in a back portion of the main body case, an intake air passage being provided from said dust separation section to said motor fan; and a noise blocking member which faces an intake vent of the motor fan with the intake air passage provided between the noise blocking member and the intake vent;

wherein the noise blocking member has a specific gravity that is larger than a specific gravity of a material composing said main body case; and wherein a surface of the noise blocking member that faces the intake vent has an area that is larger than a project area of the intake vent, which is an area of the intake vent projected along a central axis of the intake vent on the surface of the noise blocking member.

2. The electric vacuum cleaner according to claim 1, wherein said noise blocking member comprises a battery for driving said motor fan.

3. The electric vacuum cleaner according to claim 1, wherein said noise blocking member comprises a part of a wall surface of said intake air passage.

4. The electric vacuum cleaner according to claim 3, wherein said wall surface with has an opening, said noise blocking member comprises a battery for driving said motor fan and faces the intake vent of said motor fan through the opening, and said opening is closed by a part of said battery.

5. An electric vacuum cleaner comprising:

a main body case;

an intake air opening disposed in a front portion of the main body case;

a dust separation section which communicates with the intake air opening;

a motor fan provided in a back portion of the main body case, an intake air passage being provided from said dust separation section to said motor fan; and a battery which faces an intake vent of the motor fan via a wall of the intake air passage such that the intake air passage is provided between the noise blocking member and the intake vent;

wherein the battery has a specific gravity that is larger than a specific gravity of a material composing said main body case, and wherein a surface of the battery that faces the intake vent has an area that is larger than a project area of the intake vent, which is an area of the intake vent projected along a central axis of the intake vent on the surface of the battery.

6. The electric vacuum cleaner according to claim 5, that wherein said wall portion comprises a material having a thermal conductivity higher than the material composing said main body case, and said battery contacts the wall portion.

7. The electric vacuum cleaner according to claim 1, wherein said noise blocking member is positioned below said intake vent.

8. An electric vacuum cleaner comprising:

a main body case;

an intake air opening disposed in a front portion of the main body case;

a dust separation section which communicates with the intake air opening;

a motor fan provided in a back portion of the main body case, an intake air passage being provided from said dust separation section to said motor fan, and said motor fan being tilted downwardly so that an intake vent of the motor fan is directed obliquely forward toward the front portion of the main body case and obliquely downward; and a battery, for driving the motor fan, positioned under a bottom wall of a bottom portion of the intake air passage, wherein the bottom wall faces said intake vent.

* * * * *